US010538913B2

(12) United States Patent
Matthai et al.

(10) Patent No.: US 10,538,913 B2
(45) Date of Patent: Jan. 21, 2020

(54) CONNECTION ASSEMBLY FOR AN ARCHITECTURAL STRUCTURE

(71) Applicant: HERMAN MILLER, INC., Zeeland, MI (US)

(72) Inventors: John Matthai, Holland, MI (US); Robert Michael Seeley, Zeeland, MI (US); James Moon, Allegan, MI (US)

(73) Assignee: HERMAN MILLER, INC., Zeeland, MI (US)

( * ) Notice: Subject to any disclaimer, the term of this patent is extended or adjusted under 35 U.S.C. 154(b) by 0 days.

(21) Appl. No.: 15/987,790

(22) Filed: May 23, 2018

(65) Prior Publication Data

US 2019/0360198 A1 Nov. 28, 2019

(51) Int. Cl.
*E04B 2/74* (2006.01)

(52) U.S. Cl.
CPC ..... *E04B 2/7407* (2013.01); *E04B 2/7453* (2013.01)

(58) Field of Classification Search
CPC ..... E04B 2/7407; E04B 2/7453
USPC ..... 52/698
See application file for complete search history.

(56) References Cited

U.S. PATENT DOCUMENTS 2,345,650 A * 4/1944 Attwood ..... B62D 33/044 403/21
3,357,727 A * 12/1967 Finkenstein ..... F16B 17/004 403/176
3,478,993 A 11/1969 Wyeroski
3,614,044 A 10/1971 Bard
3,620,558 A * 11/1971 MacMillan ..... F16B 7/0446 403/290
3,666,298 A * 5/1972 Reilly ..... A47B 47/0008 403/172
3,977,800 A * 8/1976 Cassel ..... F16B 7/0446 403/172
3,993,720 A * 11/1976 Burdett ..... E04B 1/162 264/33
4,130,977 A * 12/1978 Taylor, Jr. ..... E04B 1/4107 52/710

(Continued)

FOREIGN PATENT DOCUMENTS

EP 1302601 A1 * 4/2003 ..... E04B 2/7453
WO 9322518 A1 11/1993

(Continued)

OTHER PUBLICATIONS

International Search Report with Written Opinion for related Application No. PCT/US2018/022184 dated Jul. 13, 2018 (18 pages).

*Primary Examiner* — Jeanette E Chapman
(74) *Attorney, Agent, or Firm* — Michael Best & Friedrich LLP

(57) ABSTRACT

A connection for a subarchitectural workspace includes a first structure with a first end and a second end opposite the first end and a second structure with a first end and a second end opposite the first end. The connection assembly further includes a first bracket with a first fine adjustment surface mounted to the first structure, a second bracket with a second fine adjustment surface that engages the first fine adjustment surface, and a clamping mechanism that applies a clamping force to the first and second fine adjustment surfaces to pull the first and second structures together.

19 Claims, 17 Drawing Sheets

(56) References Cited

U.S. PATENT DOCUMENTS 4,139,316 A * 2/1979 Svensson ..... F16B 12/50 403/172
4,204,375 A * 5/1980 Good ..... E04B 2/7425 52/239
D256,663 S 9/1980 Gilb
4,249,830 A * 2/1981 Day ..... F16B 7/0446 403/246
4,929,114 A * 5/1990 Young ..... E04B 1/5831 403/172
4,948,313 A * 8/1990 Zankovich ..... E04B 1/4107 411/103
5,005,848 A * 4/1991 Cornell ..... B62B 5/0083 108/56.1
5,394,658 A 3/1995 Schreiner et al.
5,406,760 A 4/1995 Edwards
5,893,675 A * 4/1999 Lange ..... F16B 7/0413 403/292
5,896,721 A * 4/1999 Sugiyama ..... E04B 1/2604 403/232.1
5,899,025 A 5/1999 Casey et al.
5,950,371 A 9/1999 Rives et al.
5,974,742 A 11/1999 Shreiner et al.
6,073,399 A 6/2000 Shipman et al.
6,112,472 A 9/2000 Van Dyk et al.
6,189,268 B1 2/2001 Carr et al.
6,213,679 B1 4/2001 Frobosilo et al.
6,240,682 B1 6/2001 James et al.
6,250,020 B1 6/2001 Shipman
6,279,643 B1 8/2001 Shipman
6,354,043 B1 3/2002 Simon et al.
6,374,548 B1 4/2002 Ruedinger
D462,548 S 9/2002 Ludwig et al.
6,470,644 B2 10/2002 James et al.
6,481,169 B1 11/2002 Ludwig
6,490,829 B1 12/2002 Schreiner et al.
6,497,075 B1 12/2002 Schreiner et al.
6,510,663 B2 1/2003 Jourden et al.
6,574,928 B2 6/2003 Mueller et al.
6,612,087 B2 9/2003 diGirolamo et al.
6,748,710 B2 6/2004 Gresham et al.
6,751,914 B2 6/2004 Zeh et al.
6,760,999 B2 7/2004 Branc
6,773,200 B2 * 8/2004 Cole ..... B60D 1/60 403/21
6,807,776 B2 10/2004 Girdwood et al.
6,931,795 B1 8/2005 Baloga et al.
7,249,624 B2 7/2007 Zeh et al.
7,731,160 B2 * 6/2010 Terrels ..... E04F 11/1836 256/65.03
7,827,920 B2 11/2010 Beck et al.
8,074,415 B2 12/2011 Terada et al.
8,997,413 B2 4/2015 Anderson
9,010,062 B2 4/2015 Hill
2002/0124478 A1 9/2002 Rush et al.
2003/0182871 A1 10/2003 Gresham et al.
2003/0200704 A1 10/2003 Cornell et al.
2005/0055888 A1 3/2005 Gresham et al.
2007/0033895 A1 * 2/2007 Talpe ..... F16B 13/0833 52/698
2007/0245677 A1 * 10/2007 Nguyen ..... E04B 1/2403 52/698
2010/0101167 A1 * 4/2010 Morey ..... E04B 9/183 52/506.06
2010/0126103 A1 * 5/2010 diGirolamo ..... E04B 2/58 52/655.1
2015/0308098 A1 * 10/2015 Tessadori ..... E04F 13/0807 52/698
2016/0017614 A1 * 1/2016 Kometas ..... E04F 19/0477 52/287.1
2016/0128469 A1 5/2016 Matthai et al.
2016/0138634 A1 * 5/2016 Zhang ..... E04B 1/40 52/698
2016/0153185 A1 * 6/2016 Ter-Borch ..... E06B 1/02 52/204.1
2016/0159269 A1 6/2016 Squyres

FOREIGN PATENT DOCUMENTS

WO 97017504 5/1997
WO 2014114299 A1 7/2014

* cited by examiner

CONNECTION ASSEMBLY FOR AN ARCHITECTURAL STRUCTURE

BACKGROUND

The present invention relates to an architectural structure and more specifically to a connection assembly for the architectural structure.

An architectural structure typically includes a plurality of vertical structures and a plurality of horizontal structures that are coupled together to from a workspace. The horizontal structures and the vertical structures are generally coupled to one another with fasteners. These fasteners secure the structures together but do little to keep the structures flush with one another.

SUMMARY

In one embodiment, the invention provides a connection for a subarchitectural workspace including a first structure with a first end and a second end opposite the first end and a second structure with a first end and a second end opposite the first end. The connection assembly further includes a first bracket with a first fine adjustment surface mounted to the first structure, a second bracket with a second fine adjustment surface that engages the first fine adjustment surface, and a clamping mechanism that applies a clamping force to the first and second fine adjustment surfaces to pull the first and second structures together.

In another embodiment, the invention provides a connection for a subarchitectural workspace including a first structure with a first end and a second end opposite the first end and a second structure with a first end and a second end opposite the first end. The connection further includes a first bracket extending from the first structure. The first bracket includes a first end adjacent the first structure and a first fine adjustment surface opposite the first end. The connection further includes a second bracket with a second fine adjustment surface that engages the first fine adjustment surface and a clamping mechanism that couples the first end of the first structure to the first end of the second structure to draw the first and second fine adjustment surfaces together.

In another embodiment, the invention provides a connection assembly for coupling a first structure to a second structure including a first bracket with a first end and a second end opposite the first end, a second bracket with a fine adjustment surface that engages the second end of the first bracket, and a clamping mechanism that applies a clamping force to draw the first bracket into engagement with the fine adjustment surface to urge the first and second structures together.

In another embodiment, the invention provides a connection assembly for coupling a first structure to a second structure including a first bracket extending from the first structure. The first bracket includes a first fine adjustment surface. The connection further includes a clamping mechanism with a second fine adjustment surface that engages the first fine adjustment surface and applies a clamping force to the first and second fine adjustment surfaces to urge the first and second structures together.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. It should be understood that the description of specific embodiments is not intended to limit the disclosure from covering all modifications, equivalents, and alternatives falling within the spirit and scope of the disclosure. Also, it is to be understood that the phraseology and terminology used herein is for the purpose of description and should not be regarded as limiting.

DETAILED DESCRIPTION

The term "laterally" or variations thereof refer to a sideways direction. The terms "top," "upper," "bottom," and "lower" are intended to indicate directions when viewing the architectural structure when positioned for use. The term "horizontal" is intended to indicate a direction substantially orthogonal to a ground or base. The term "vertical" is intended to indicate a direction substantially parallel to a ground or base. The term "coupled" means connected to or engaged with, whether either directly or indirectly, for example with an intervening member, and does not require the engagement to be fixed or permanent, although engagement can be fixed or permanent. The terms "coupled" or "coupling" for example could indicate welding two members together, securing two members with fasteners, or any other means of adjoining two members. It should be understood that the use of numerical terms "first," "second," "third," etc. as used herein does not refer to any particular sequence or order of components; for example, "first" and "second" portions may refer to any sequence of such components, and is not limited to the first and second components of a particular configuration.

Figure 1:
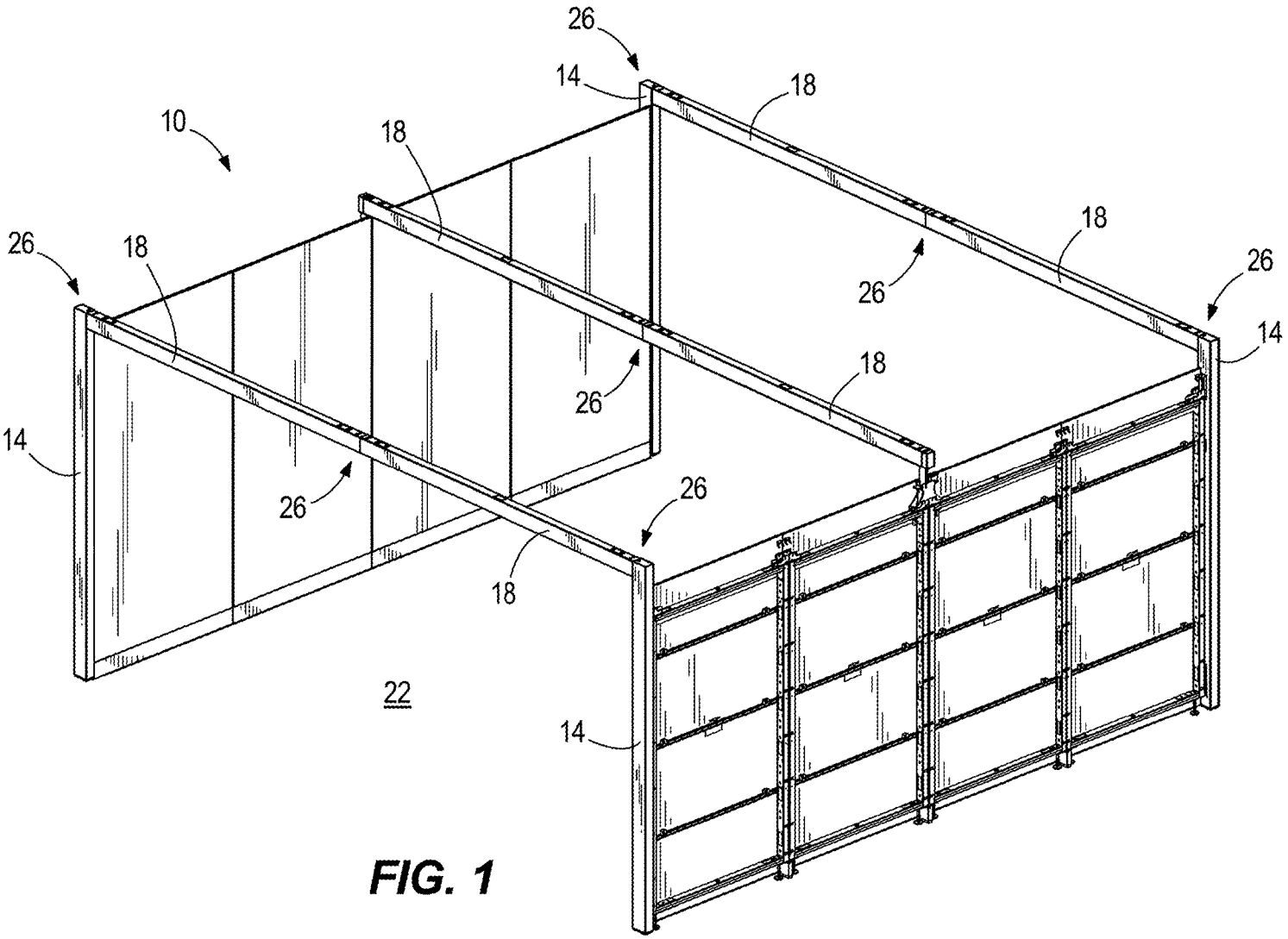
FIG. 1 is a perspective view of an architectural structure.

FIG. 1 illustrates an architectural structure 10 including a plurality of vertical structures (e.g., posts 14) and a plurality of horizontal structures (e.g., beams 18) supported on a surface 22. The architectural structure 10 may be, for example, a subarchitectural workspace that is used for creating sub-workspaces within an office. The subarchitectural workspace is able to break up the floor of an office into separate functional areas. The architectural structure 10 may also be any structure that subdivides a room. Additional beams 18 or posts 14 may be added to the architectural structure 10 to provide a bigger space or room or to even create multiple rooms or spaces. The architectural structure 10 is also capable of supporting walls that may further break up or separate different functional areas from one another.

Additionally, various accessories can be attached to the architectural structure 10. For example, light fixtures may be hung from or attached to the beams 18 or the posts 14. Banners, screens, panels, dividers, curtains, and other partitions may also be hung from the beams 18. The architectural structure 10 may further include partitions that may be slidable along tracks or otherwise movable relative to the beams 18 to change the configuration of the architectural structure 10. In some embodiments, false ceiling elements may be coupled to and extend from the beams 18. Other accessories, such as easels, whiteboards, horizontal surfaces, support hooks, mounting racks, etc., may also be supported by the architectural structure 10.

With reference to FIGS. 1, 2 and 8-13, the plurality of beams 18 and posts 14 of the architectural structure 10 are coupled to each other using a connection assembly 26. The connection assembly 26 can be used to couple a beam 18 to a post 14 (FIGS. 2, 8-10), a beam 18 to another beam 18 (FIGS. 11-13), a post 14 to another post 14 (not shown), or any other two structures or members together. Specifically, the connection assembly 26, when fully secured, provides fine adjustment between a first structure to a second structure so there is a minimal distance between the two structures. As used herein, the term "fine adjustment" and derivatives, such as "finely adjust," mean the relatively small adjustments between the two structures during final assembly, which adjustments would be very difficult or impossible through manual alignment due to the size of the structures and the precision required for the application. In the illustrated embodiments, the fine adjustment involves drawing a beam 18 toward a post 14 or another beam 18 to bring the beam 18 and post 14 or other beam 18 into very close proximity or into abutment for a tighter or more stable or more aesthetically pleasing joint. For reference, each beam 18 has a beam axis 28 (FIGS. 2, 4, 10, 13) extending along the longitudinal extent of the beam 18.

Figure 2:
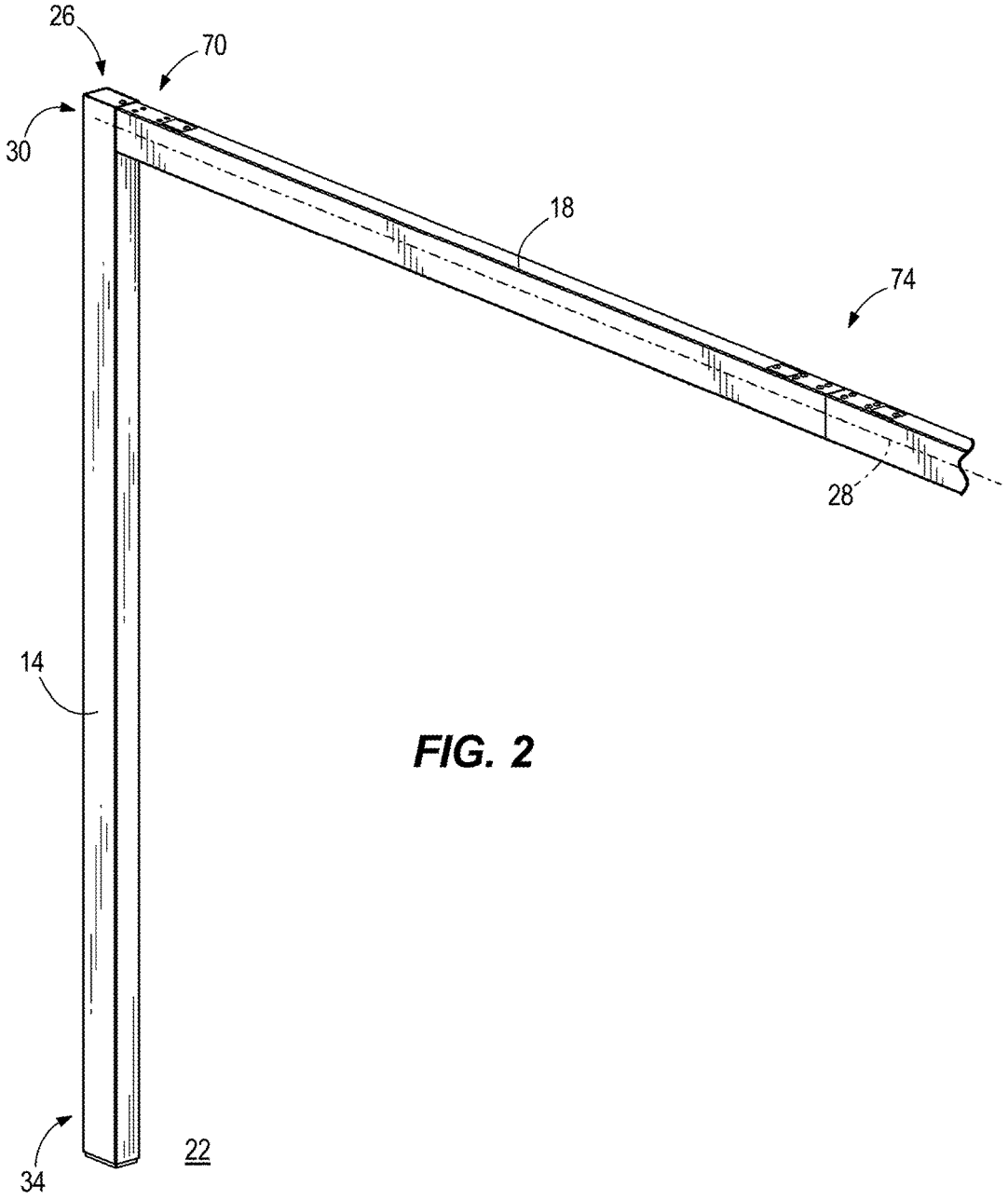
FIG. 2 is a perspective view of a beam and post connection within the architectural structure of FIG. 1.
Figure 3:
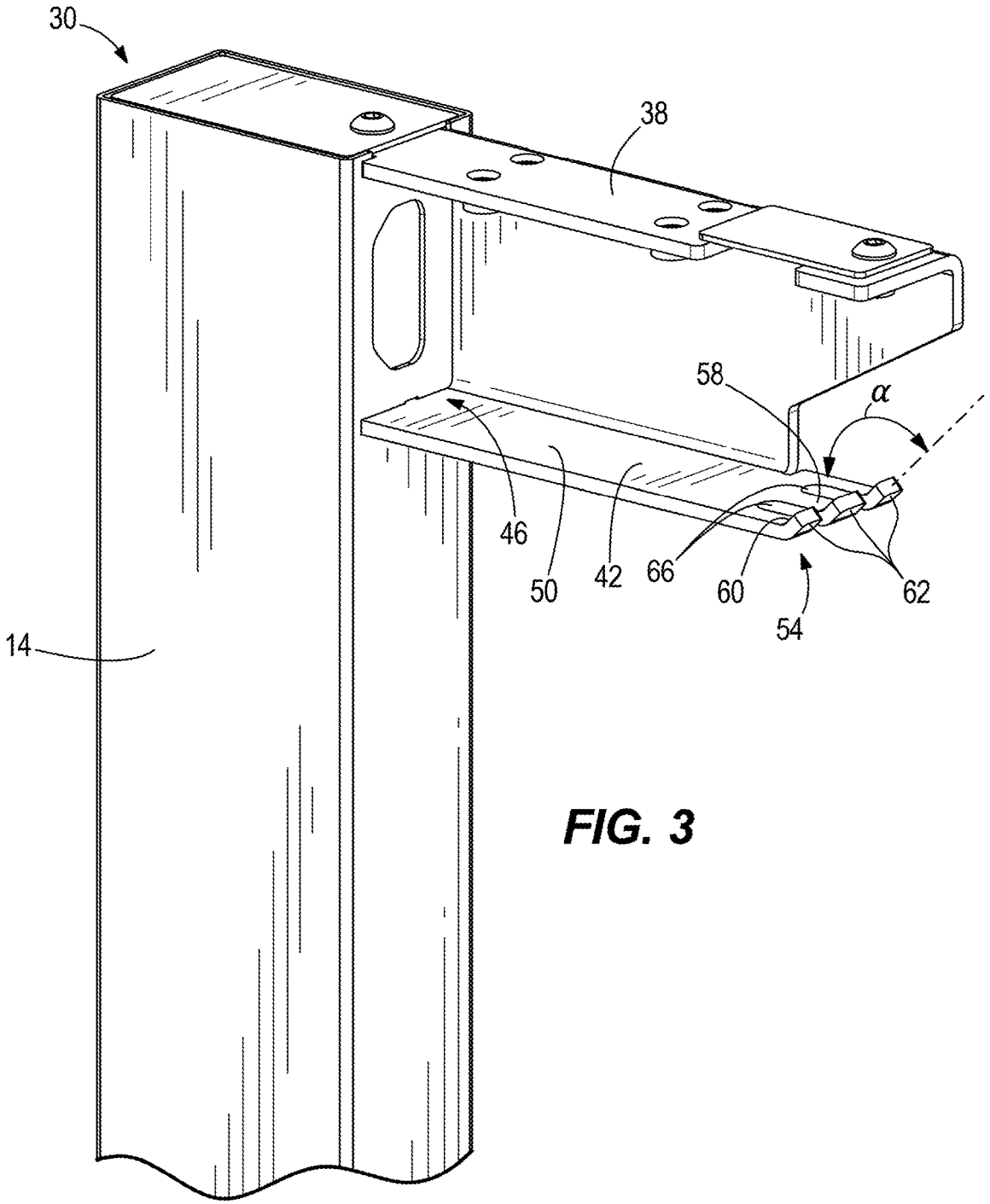
FIG. 3 is a perspective view of the post of FIG. 2.

With reference to FIGS. 2 and 3, the post 14 of the architectural structure 10 includes a first end 30 and a second end 34 opposite the first end 30, the second end 34 being supported on the surface 22. The post 14 extends substantially perpendicular from the surface 22. The post 14 further includes a bracket 38 extending laterally from the first end 30 of the post 14. The bracket 38 is generally C-shaped and includes a lower arm 42 that has a first end 46 adjacent the post 14 with a flat surface 50 and a bent end 58 opposite the first end 46. The bent end 58 is at an obtuse fine adjustment angle $\alpha$ with respect to the flat surface 50. The upper face of the bent end 58 defines a fine adjustment surface 60. The bent end 58 includes a plurality of fingers 62 that define slots 66 in between the fingers 62. In the illustrated embodiment, the bent end 58 includes three fingers 62 and two slots 66. In other embodiments, the bent end 58 could include fewer or more fingers 62 that define fewer or more slots 66.

Figure 4:
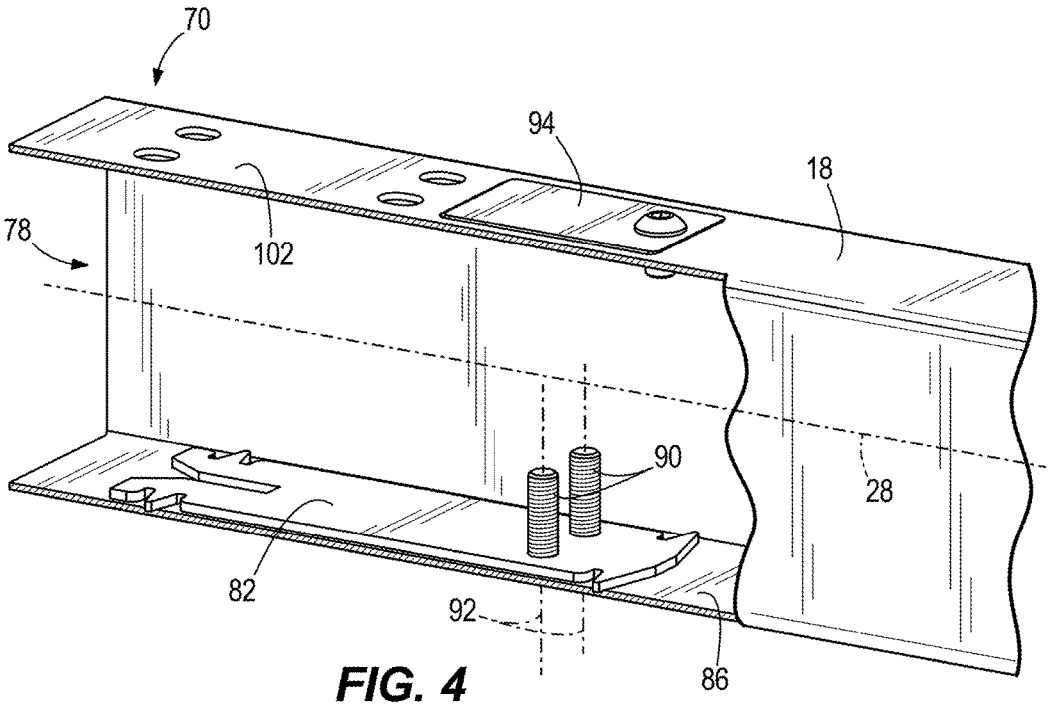
FIG. 4 is a perspective view of a partial cross-section of the beam of FIG. 2.

With reference to FIGS. 2 and 4, the beam 18 of the architectural structure 10 includes a first end 70 and a second end 74 opposite the first end 70. The beam 18 is generally hollow and includes a cavity 78 that extends from the first end 70 of the beam 18 to the second end 74 of the beam 18. On both the first and second ends 70, 74 of the beam 18, within the cavity 78 is a support 82 coupled to (e.g., by welding or through fasteners) a bottom surface 86 of the cavity 78. The support 82 includes two fasteners 90 that correspond to the slots 66 of the bracket 38 and extend upwardly from the support 82. Each fastener 90 extends along a longitudinal fastener axis 92. In some embodiments, the fasteners 90 extend directly from the bottom surface 86 of the cavity 78, thereby obviating the need for the support 82. In the illustrated embodiment, the fasteners 90 are threaded studs. In other embodiments, the fasteners 90 can be screws, nails, bolts, clamps or any other member that can extend from the bottom surface 86 of the cavity 78. In further embodiments, there may be fewer or more fasteners 90 extending from the support 82 or the bottom surface 86. The beam further includes a cap 94 at both the first and second ends 70, 74.

Figure 5:
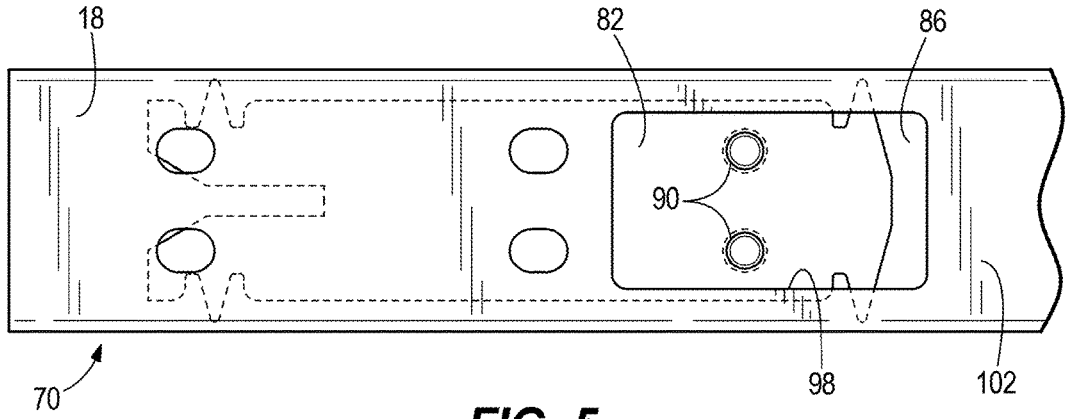
FIG. 5 is a top view of the beam of FIG. 2 with a top cap removed.

As shown in FIG. 5, the cap 94 has been removed to reveal an opening 98 on a top surface 102 of the beams 18 at the first and second ends 70, 74. The openings 98 are positioned over the fasteners 90. The caps 94 are coupled to the beam 18 and bracket 38 with a fastener and can be removed to expose the opening 98 to allow access to the cavity 78 and the fasteners 90 positioned opposite the opening 98.

Figure 6:
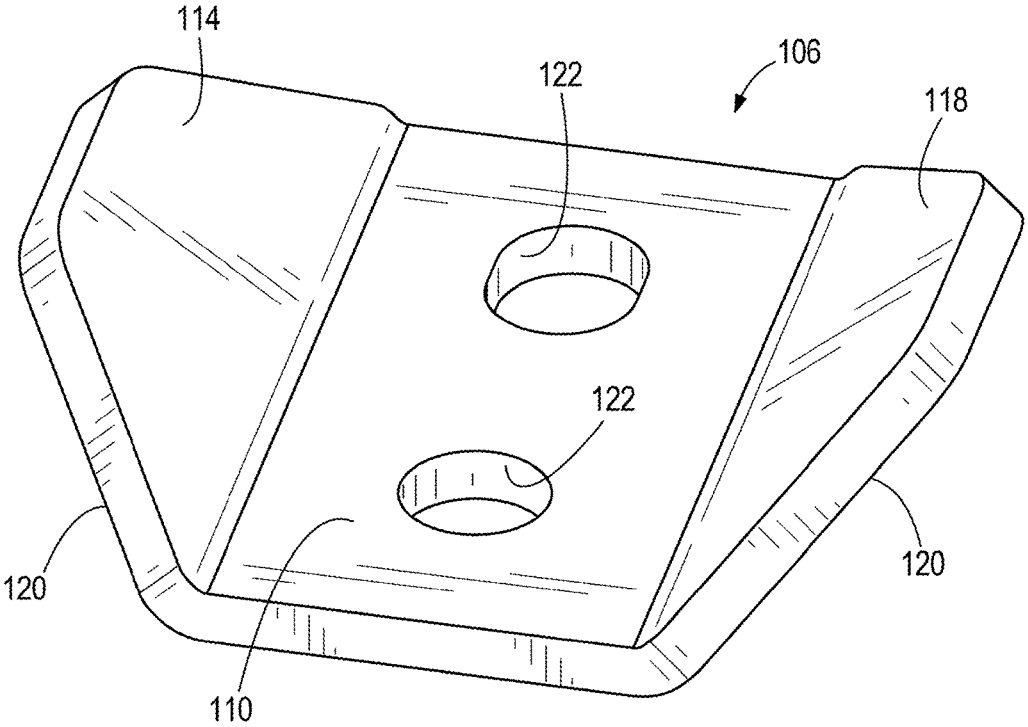
FIG. 6 is a perspective view of a fine adjustment bracket.
Figure 7:
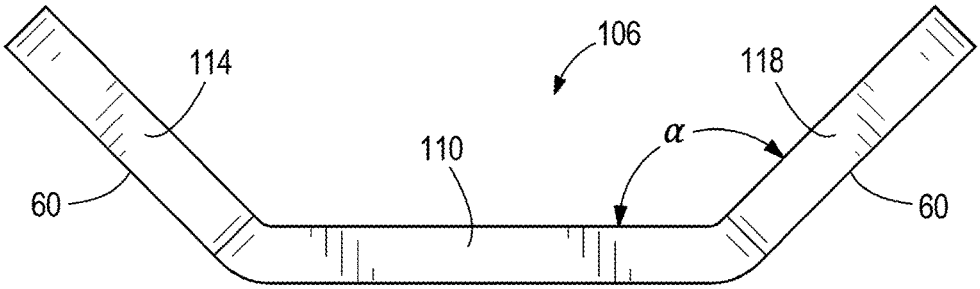
FIG. 7 is a side view of the fine adjustment bracket of FIG. 6.

FIGS. 6 and 7 illustrate a fine adjustment bracket 106 including a middle portion 110, a first flange 114, and a second flange 118. The bottom surfaces of the first flange 114 and second flange 118 define fine adjustment surfaces 120 that correspond (e.g., in fine adjustment angle $\alpha$ and length) to the above-described fine adjustment angle $\alpha$ and length of the fine adjustment surface 60 of the bent end 58 of the bracket 38. With reference to FIG. 7, the fine adjustment angle $\alpha$ is the angle at which the fine adjustment surfaces 120 extend up from the flat bottom of the fine adjustment bracket. For the illustrated bracket (on which the upper and lower surfaces are parallel), the included angle between the middle portion 110 and flanges 114, 118 is also equal to the fine adjustment angle $\alpha$. The fine adjustment angle $\alpha$ is obtuse and may be in the range of 100-150 degrees. The illustrated fine adjustment angle $\alpha$ is 120 degrees. In other embodiments, the fine adjustment angles $\alpha$ and lengths of the first flange 114 and second flange 118 may be different from each other to accommodate multiple configurations (e.g., angles and lengths) of the bent end 58 of the associated bracket 38.

The fine adjustment bracket 106 further includes apertures 122 on the middle portion 110. In the illustrated embodiment, the fine adjustment bracket 106 includes two apertures 122 on the middle portion 110. In other embodiments, the fine adjustment bracket 106 may include fewer or more than two apertures 122. In further embodiments, the apertures 122 could be positioned on either the first or second flange 114, 118.

Figure 8:
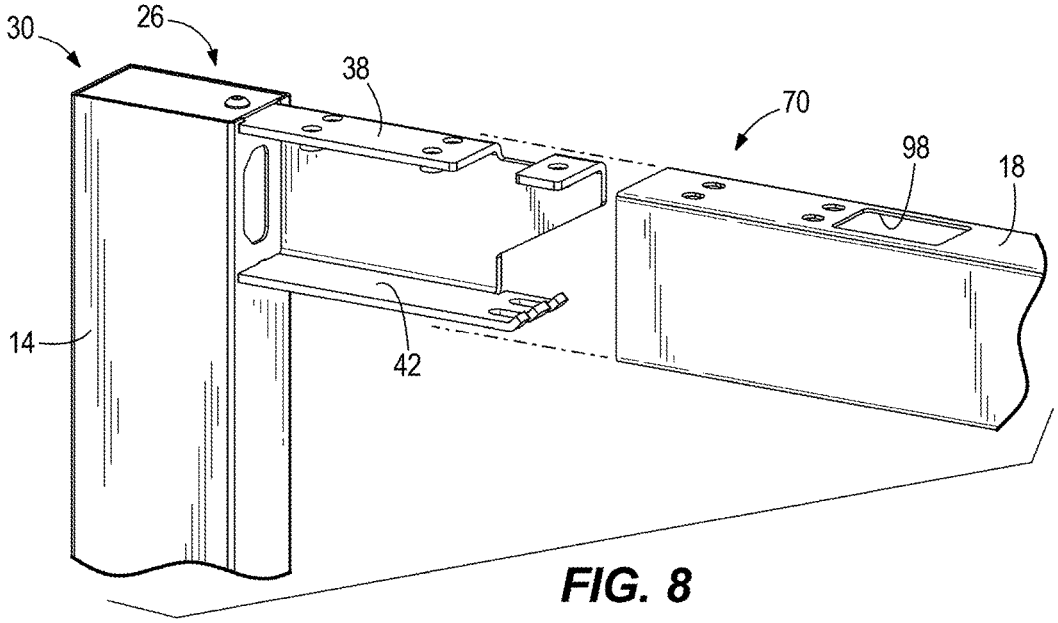
FIG. 8 is an exploded view of the beam and post connection of FIG. 2.
Figure 9:
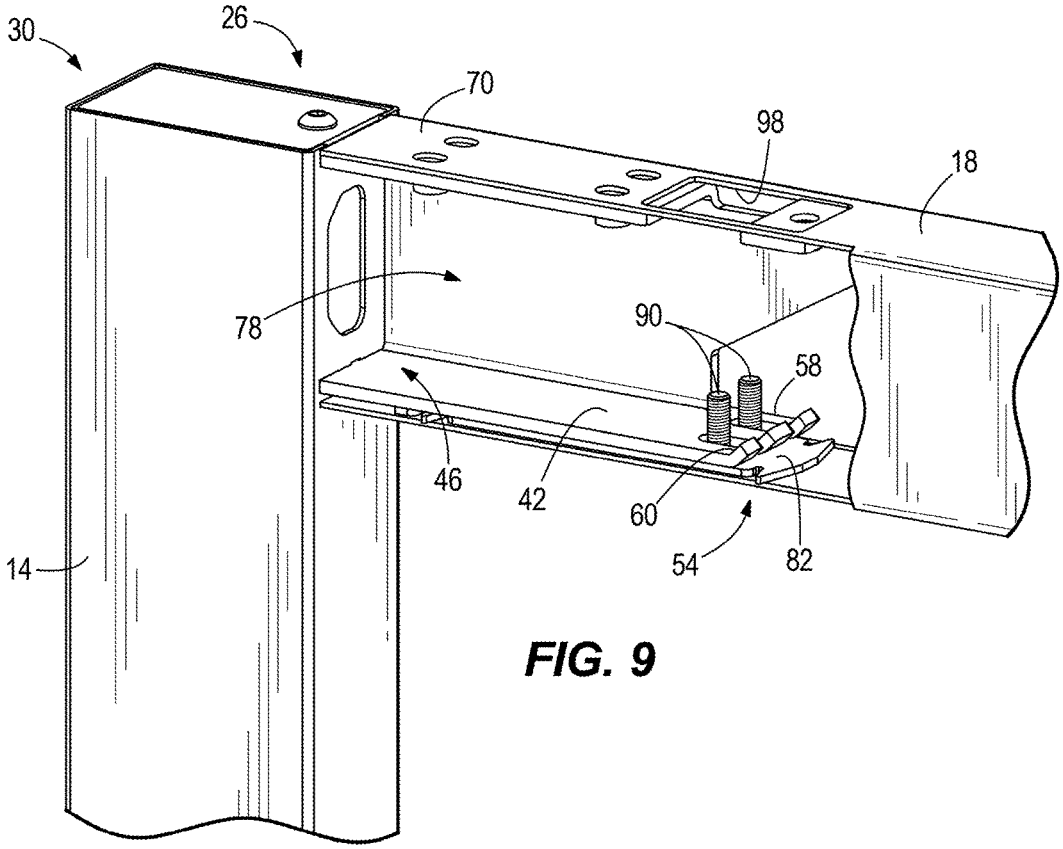
FIG. 9 is a perspective view of a partial cross-section of the beam to post connection of FIG. 2 without a fine adjustment bracket.
Figure 10:
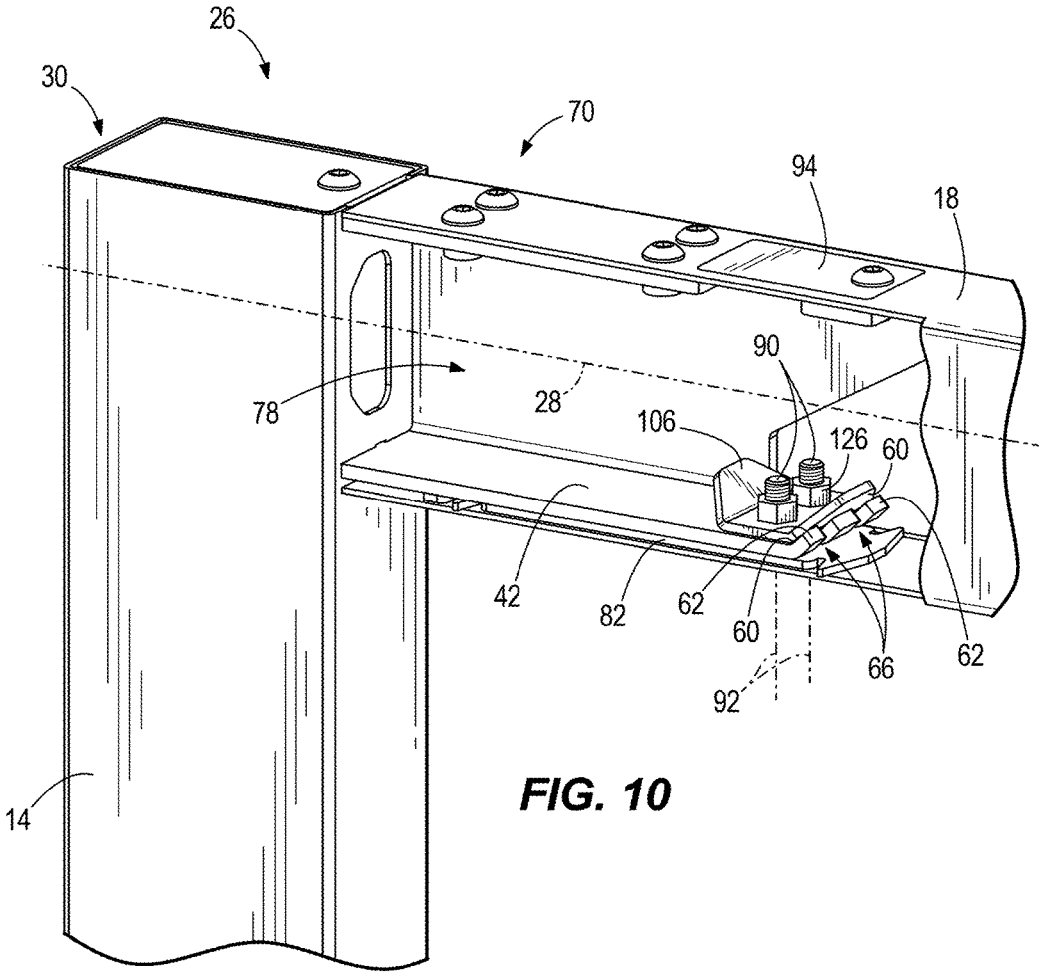
FIG. 10 is a perspective view of the partial cross-section of the beam to post connection of FIG. 9 with a fine adjustment bracket.

FIGS. 8-10 illustrate a connection assembly 26 for coupling a post 14 to a beam 18. The connection assembly 26 includes the fine adjustment surface 60 of the bent end 58, the fine adjustment surface 120 of the fine adjustment bracket 106, the fasteners 90, and a nut 126 on each fastener 90. As illustrated in FIG. 8, the bracket 38 of the post 14 is aligned with the cavity 78 in the first end 70 of the beam 18 and the beam 18 is slid over the bracket 38.

As illustrated in FIG. 9, when the bracket 38 is fully received within the cavity 78, the first end 30 of the post 14 and the first end 70 of the beam 18 abut each other at a desired angle (e.g., a right angle as illustrated). As the beam 18 is slid over the bracket 38, the fasteners 90 register with (i.e., are received in) the slots 66 in the bracket 38.

As illustrated in FIG. 10, the fine adjustment bracket 106 is inserted into the cavity 78 through the opening 98 and positioned on the lower arm 42 of the bracket 38 with the fasteners 90 extending through the apertures 122 of the fine adjustment bracket 106. The first or second flange 114, 118 of the fine adjustment bracket 106 rests against the bent end 58. In this regard, the fine adjustment surface 60 of the bent end 58 and the fine adjustment surface 120 of the flange 114 or 118 rest against each other. The nuts 126 are then lowered through the opening 98 and threaded onto the fasteners 90 to secure the fine adjustment bracket 106 to the lower arm 42. As the nuts 126 are tightened on the fasteners 90, a clamping force is generated between the nuts 126 and the bottom surface 86 of the cavity 78 in the beam 18.

The clamping force is collinear with the longitudinal axes 92 of the fasteners 90 and perpendicular to the beam axis 28. The clamping force draws the fine adjustment bracket 106 against the bent end 58 of the bracket 38. The fine adjustment bracket 106 nests into the bent end 58 of the lower arm 42. More specifically, the fine adjustment surface 120 of the fine adjustment bracket 106 and the fine adjustment surface 60 of the bent end 58 slide against each other under the influence of the clamping force. Because the fine adjustment surfaces 60, 120 are at a non-zero fine adjustment angle $\alpha$ with respect to the beam axis 28, the clamping force is divided into a component that is perpendicular to the beam axis 28 (i.e., parallel to the fastener axis 92) and a component that is parallel to the beam axis 28 (i.e., perpendicular to the fastener axis 92). The component of force that is parallel to the beam axis 28 draws the beam 18 toward the post 14 (i.e., causes the beam 18 to slide over the bracket 38 toward the end 30 of the post 14) for a snug fit in the illustrated embodiment. In other embodiments, the fit may not be perfectly snug but the beam 18 is drawn into very close proximity to the post 14 to make the joint more stiff. Thus, the beam 18 is secured flush to the post 14. Additional fasteners can be used to further secure the beam 18 against the post 14.

Figure 11:
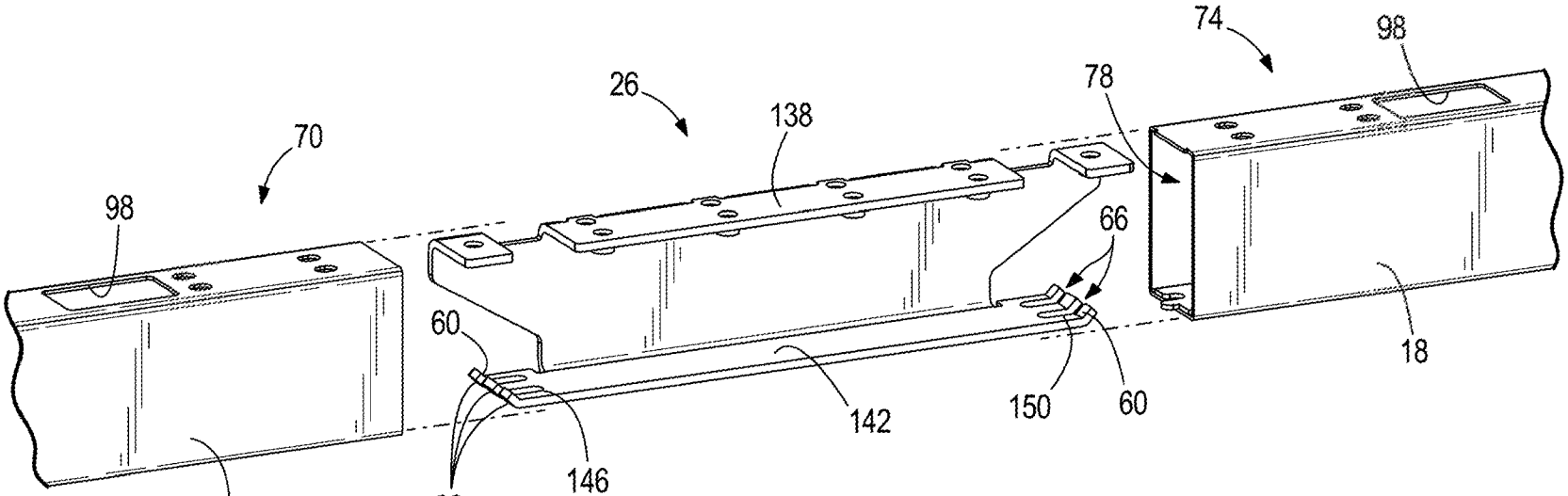
FIG. 11 is an exploded view of a beam to beam connection.
Figure 12:
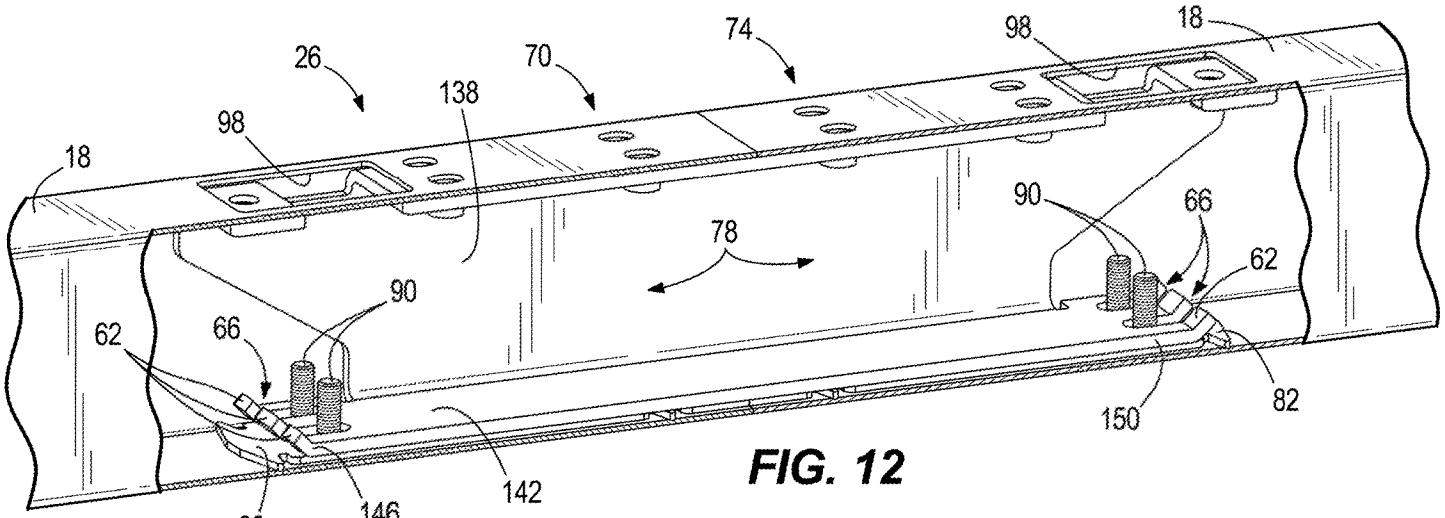
FIG. 12 is a perspective view of a partial cross-section of the beam to beam connection of FIG. 11 without fine adjustment brackets.
Figure 13:
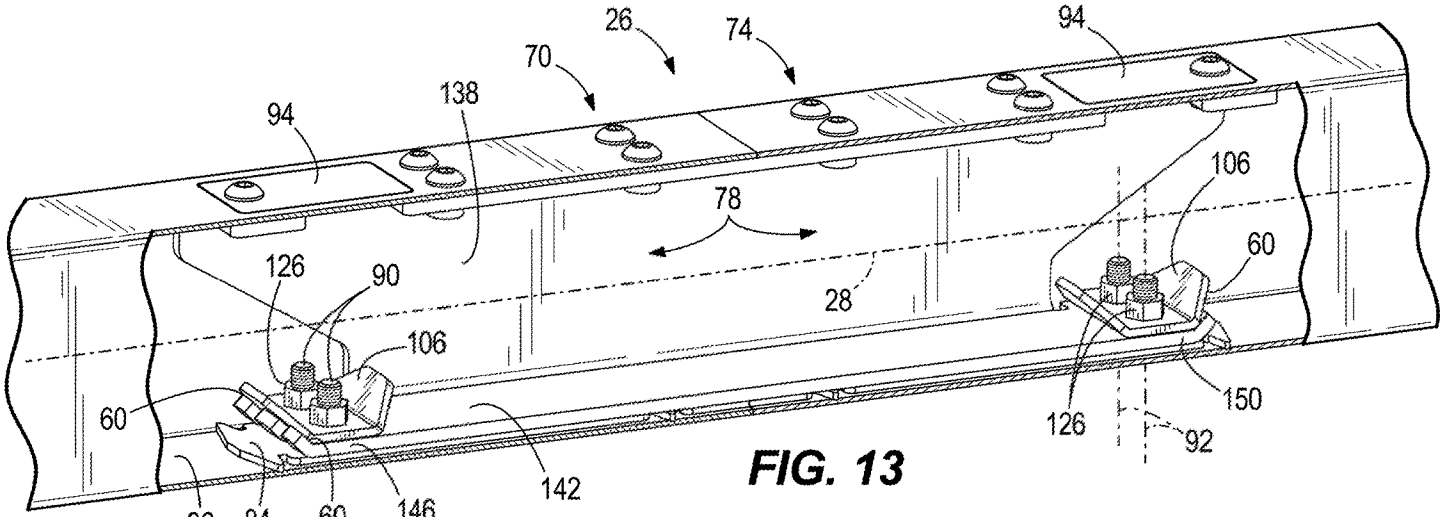
FIG. 13 is a perspective view of the partial cross-section of the beam to beam connection of FIG. 11 with fine adjustment brackets.

FIGS. 11-13 illustrate a connection assembly 26 for coupling a beam 18 to a beam 18 in parallel, end-to-end (i.e., with the beam axes 28 of the two beams 18 collinear). The connection assembly 26 includes a bracket 138 and two fine adjustment brackets 106. The bracket 138 is similar to the bracket 38 but includes a lower arm 142 that has a first bent end 146 with a fine adjustment surface 60 and a second bent end 150 with a fine adjustment surface 60. The first bent end 146 and the second bent end 150 include a plurality of fingers 62 that define slots 66 in between.

With reference to FIG. 11, during assembly, the bent ends 146, 150 of the bracket 138 are aligned with the open ends of the first and second beams 18. With reference to FIG. 12, the beams 18 are slid toward each other over the opposite ends 146, 150 of the bracket 138 to position the fasteners 90 in the slots 66 at each end 146, 150 of the bracket 138. The openings 98 allow access to the cavity 78 of the beams 18 and the fasteners 90 opposite the openings 98.

Referring now to FIG. 13, first and second fine adjustment brackets 106 are positioned on the fasteners 90 at the respective first and second bent ends 146, 150 of the bracket 138, with the fasteners 90 extending through the apertures 122 of the fine adjustment brackets 106. The fine adjustment surfaces 60, of the bent ends 146, 150 and the fine adjustment surfaces 120 of respective first and second fine adjustment brackets 106 interface with each other. Nuts 126 are passed through the openings 198 and threaded onto the fasteners 90. As the nuts 126 are tightened, a clamping force collinear with the fastener axes 92 is generated which pushes the fine adjustment brackets 106 against the first and second bent ends 146, 150 of the lower arm 142. As with the fine adjustment surfaces 60, 120 described above with respect to assembling a beam 18 to a post 14, a component of force parallel to the beam axes 28 arises from the obtuse angle of the fine adjustment surfaces 60, 120. The parallel component of force draws the first and second beams 18 toward each other along the beam axes 28 to a snug fit or to very close proximity to tighten the joint. Thus, the first beam 18 is secured completely flush to the second beam 18 in an end-to-end parallel butt joint.

Figure 14:
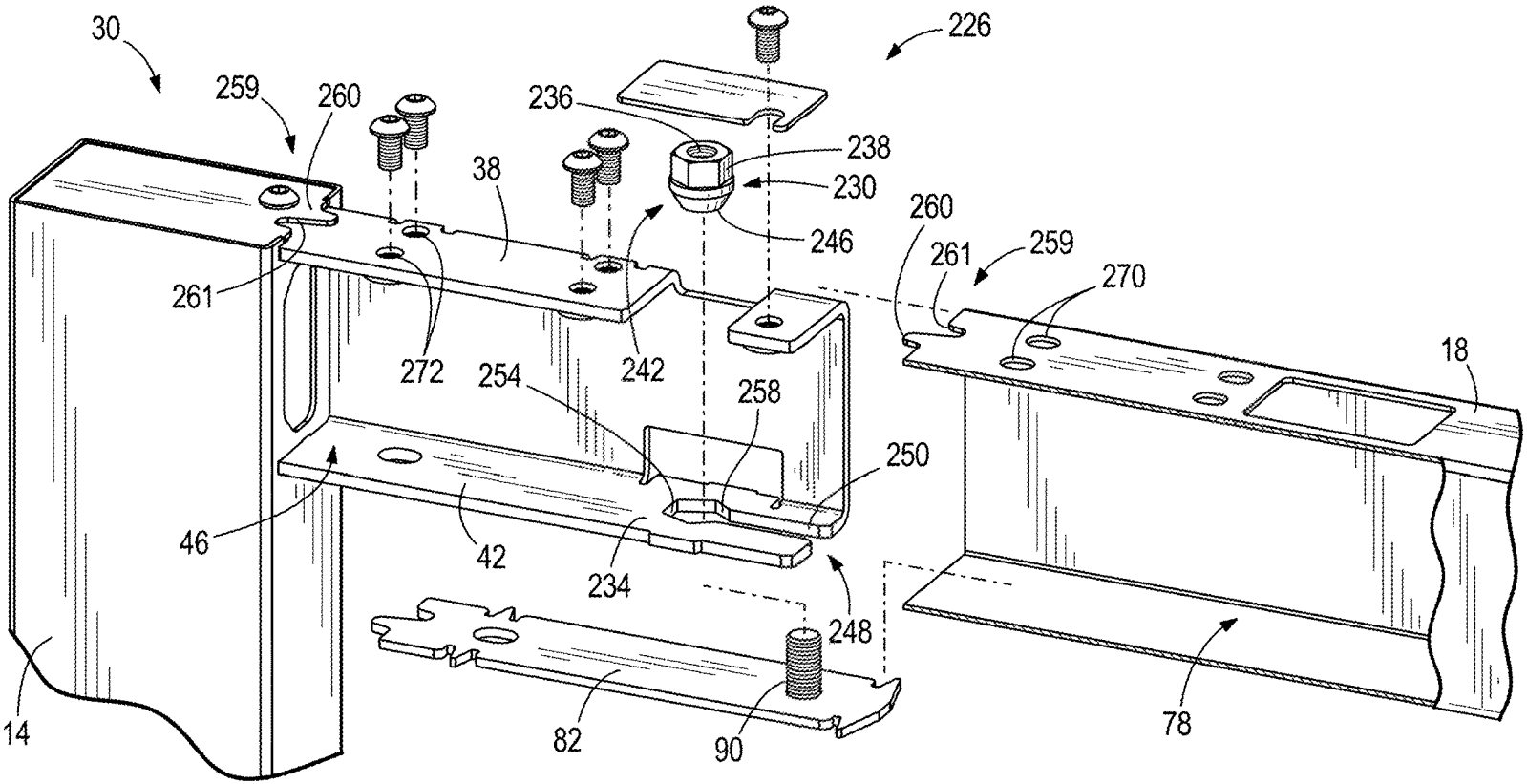
FIG. 14 is an exploded view of a beam and post connection according to another embodiment of the invention.
Figure 15:
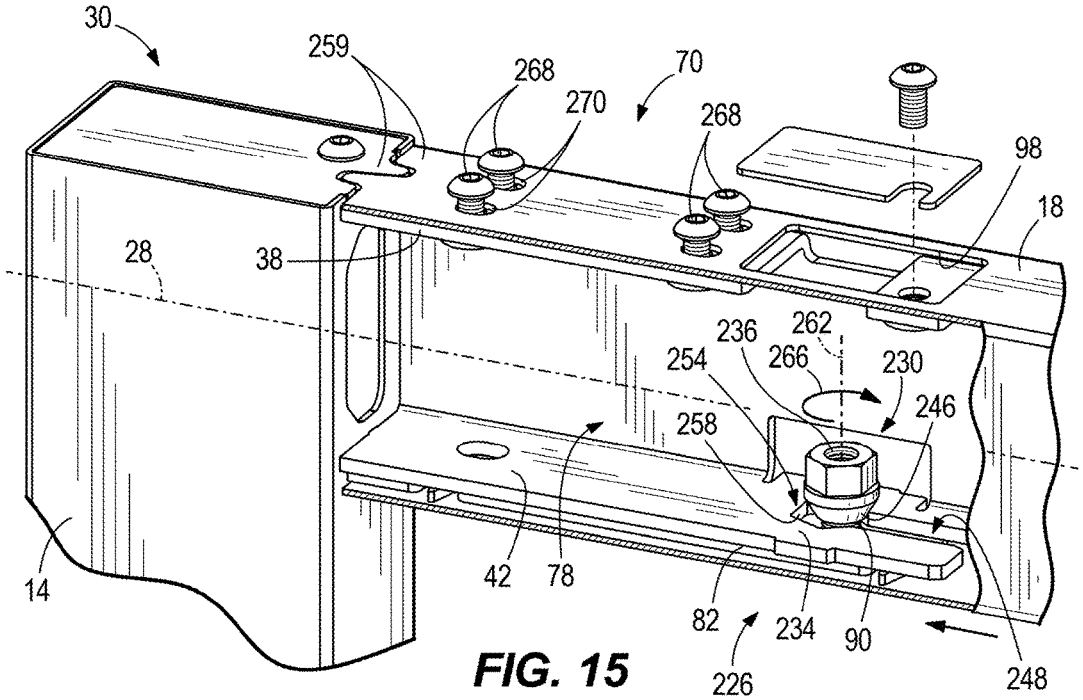
FIG. 15 is a perspective view of a partial cross-section of the beam and post connection of FIG. 14.
Figure 16:
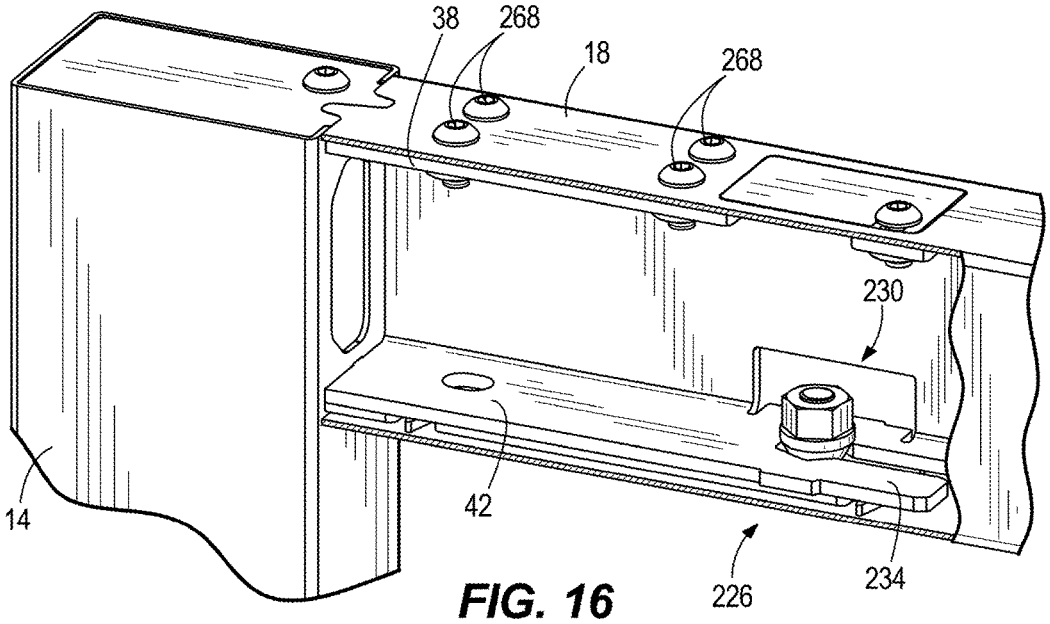
FIG. 16 is a perspective view of a partial cross-section of the beam and post connection of FIG. 14 assembled.

FIGS. 14-16 illustrate a connection assembly 226 according to another embodiment of the invention. The connection assembly 226 is similar to the connection assembly 26 with like features being represented by like references numbers. In the illustrated embodiment, the connection assembly 226 couples a post 14 to a beam 18. In other embodiments, the connection assembly 226 may couple a post 14 to a post 14 or a beam 18 to another beam 18. The connection assembly 226 includes a conical nut 230 instead of a nut 126 and a flat end 234 of the lower arm 42 of the bracket 38 instead of the bent end 58.

With reference to FIG. 14, the conical nut 230 includes an opening 236, a nut head 238, and a lower conical portion 242 that defines a fine adjustment surface 246 on an outer periphery. The flat end 234 is opposite the first end 46 of the lower arm 42 and is generally planar. The flat end 234 includes a slot 248 having a channel 250 ending in an opening 254. The inside surface of the opening 254 defines a fine adjustment surface 258 that corresponds to the fine adjustment surface 246 on the conical nut 230.

In the illustrated embodiment, the first end 30 of the post 14 includes an alignment tab 259 that corresponds to an alignment tab 259 on the beam 18. Each alignment tab 259 includes a male projection 260 and a female recess 261. When positioned for use, the male projection 260 is positioned in the female recess 261 of a corresponding alignment tab 259 and vice-versa. The projection tabs 259 prevent relative horizontal sliding the post 14 and beam 18. In other embodiments, the beams 18 include alignment tabs 259 on both the first and second ends 70, 74. In further embodiments, as described in more detail below, projection tabs 259 are also used to align beam 18 to beam 18 connections.

As illustrated in FIG. 15, the bracket 38 of the post 14 is aligned with the cavity 78 in the first end 70 of the beam 18 and the beam 18 is slid over the bracket 38 until the alignment tab 259 on the first end 30 of the post 14 and the alignment tab 259 on the beam 18 are mated. Once the bracket 38 is fully received within the cavity 78, the first end 30 of the post 14 and the first end 70 of the beam 18 abut each other at a desired angle (e.g., at a right angle as illustrated). As the beam 18 is slid toward the bracket 38, a fastener 90 on the support 82 registers with the slot 248 of the flat end 234 and into the opening 254. The conical nut 230 is then inserted into the cavity 78 through the opening 98 of the beam 18 and positioned on the fastener 90 with the fastener 90 extending though the opening 236. The conical nut 230 is then tightened by clockwise rotation about an axis 262 defined by the fastener 90, as indicated by arrow 266. As the conical nut 230 is tightened, the fine adjustment surface 246 on the conical nut contacts the fine adjustment surface 258 of the slot 248 to generate a clamping force.

The clamping force is collinear with the axis 262 of the fastener 90 and perpendicular to the beam axis 28. The clamping force draws the conical portion 242 of the conical nut 230 against the inside opening 254 of the slot 248. More specifically, the fine adjustment surface 246 of the conical nut 230 and the fine adjustment surface 258 of the flat end 234 slide against each other under the influence of the clamping force. Because the fine adjustment surfaces 246, 258 are at a non-zero fine adjustment angle with respect to the beam axis 28, the clamping force is divided into a component that is perpendicular to the beam axis 28 (i.e., parallel to the fastener axis 262) and a component that is parallel to the beam axis 28 (i.e., perpendicular to the fastener axis 262). The component of force that is parallel to the beam axis 28 draws the beam 18 toward the post 14 (i.e., causes the beam 18 to slide over the bracket 38 toward the end 30 of the post 14) for a snug fit. Thus, the beam 18 is secured flush to the post 14. Finally, fasteners 268 are secured to apertures 270 in the beam 18 and apertures 272 (FIG. 14) in the bracket 38. The fasteners 268 prevent the beam 18 from moving in a direction parallel to the fastener axis 262 relative to the bracket 38 and the post 14. The number (four in the illustrated embodiment) and spacing of the fasteners 268 also ensure a planar clamping action between the top of the beam 18 and the top of the bracket 38. The top of the bracket 38 is therefore a datum or reference surface against which the top wall of the beam 18 is clamped. Because the fasteners 268 are arranged in a non-linear pattern (e.g., at least three non-linear points to define a plane), they clamp the top of the beam 18 flush against the top of the bracket 38. The top of each beam 18 is not permitted to tip up or down with respect to the top of the bracket 38 and is held flat in the same plane as the top of the post 14. As such, the top surface of the beam 18 is flush with the top end of the post 14 at the joint.

Figure 17:
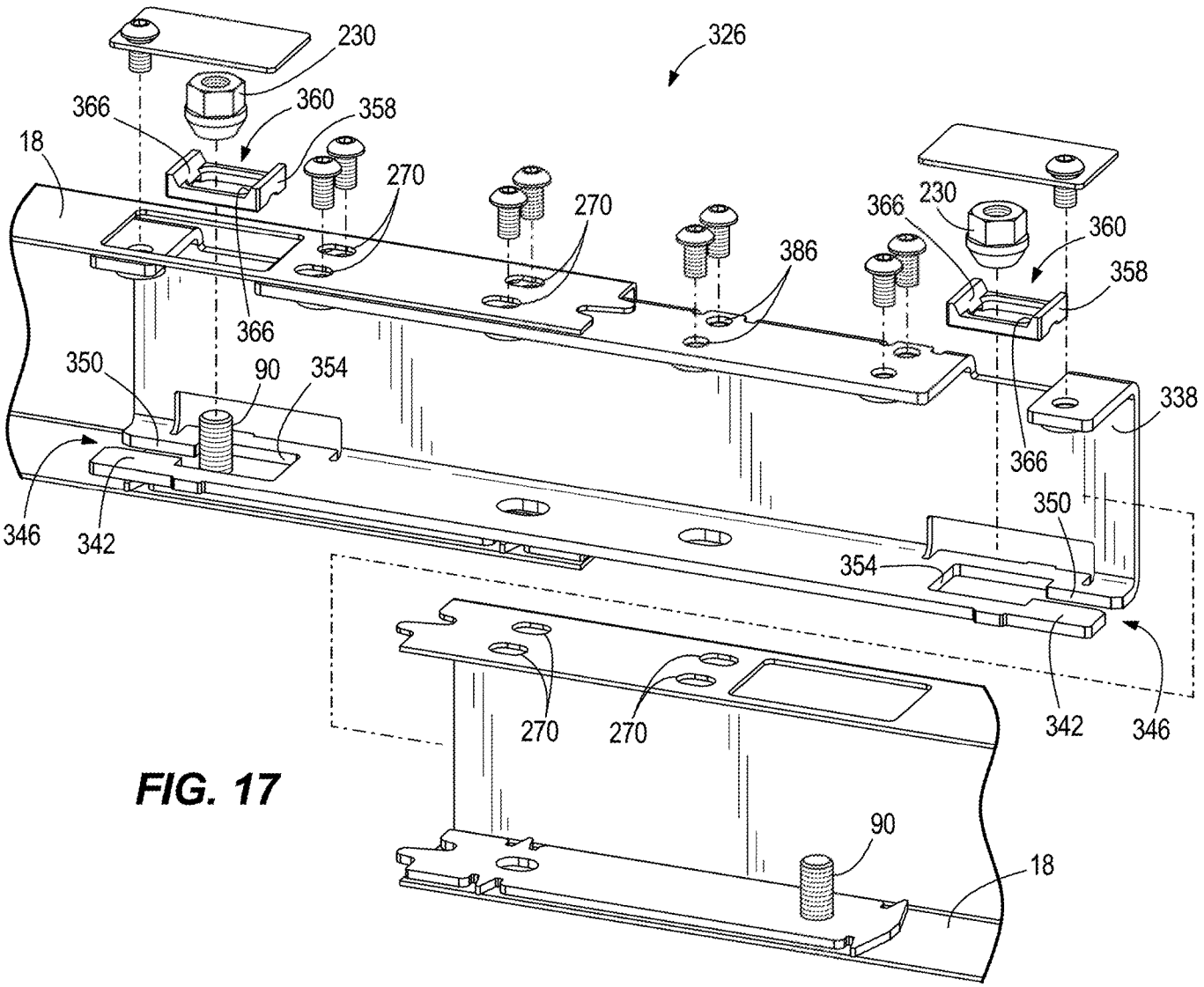
FIG. 17 is an exploded view of a beam and beam connection according to another embodiment of the invention.
Figure 18:
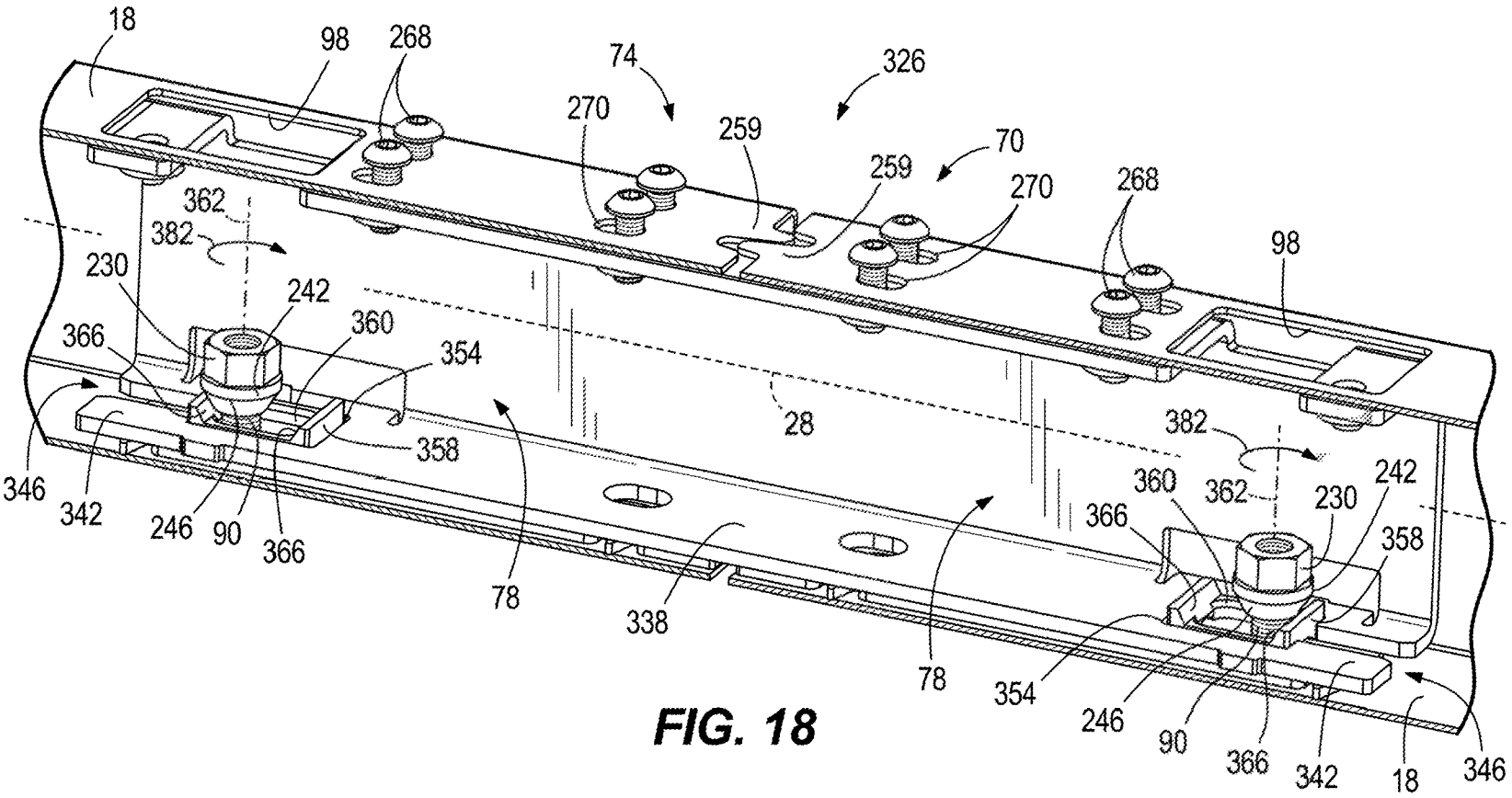
FIG. 18 is a perspective view of a partial cross-section of the beam and beam connection of FIG. 17.
Figure 19:
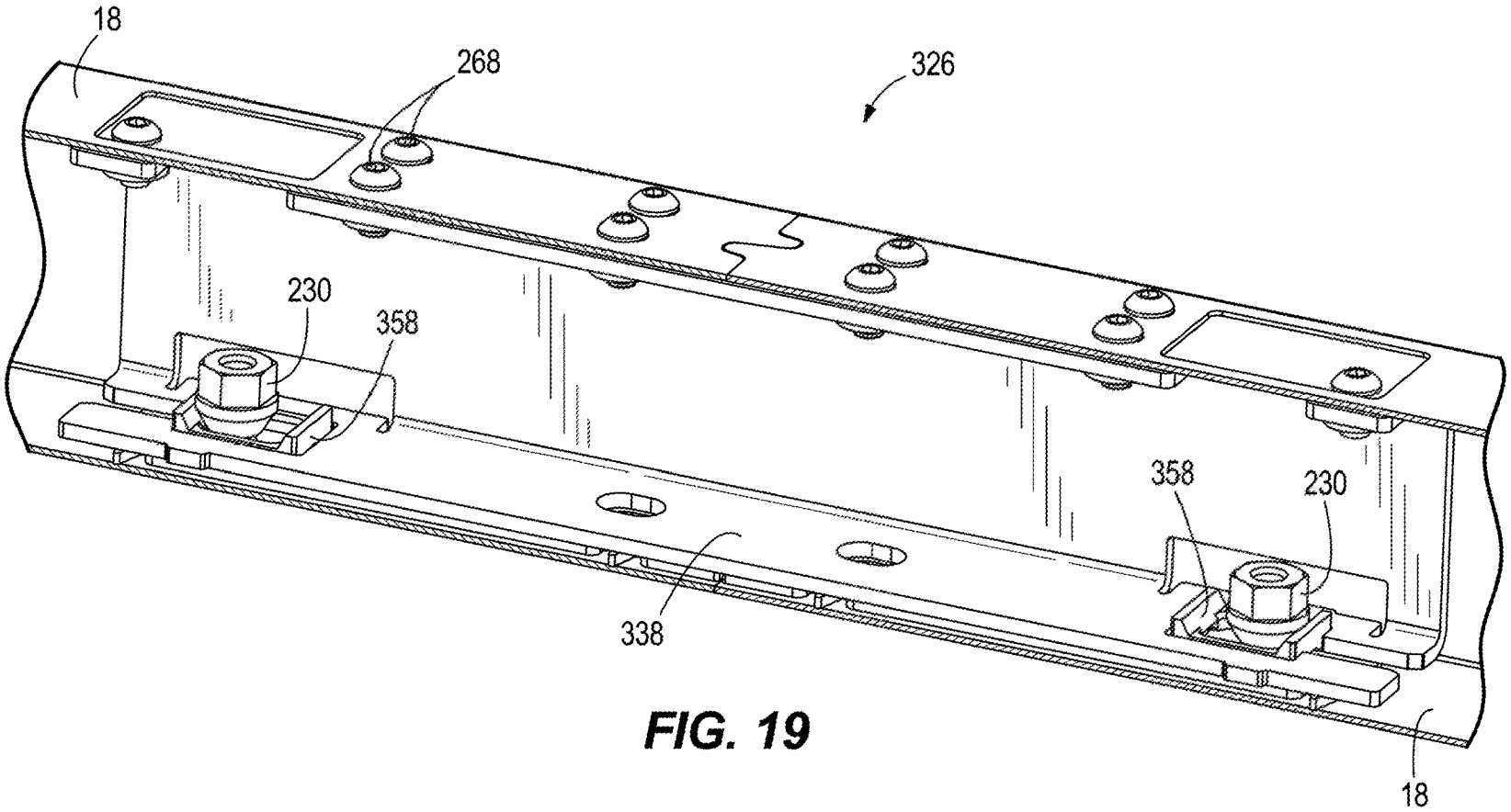
FIG. 19 is a perspective view of a partial cross-section of the beam to beam connection of FIG. 17 assembled.

FIGS. 17-19 illustrate a connection assembly 326 for coupling a beam 18 to a beam 18 in parallel, end-to-end (i.e., with the beam axes 28 of the two beams 18 collinear). In other embodiments, the connection assembly 326 may couple a post 14 to a beam 18. The connection assembly 326 is similar to the connection assembly 26 with similar features being represented by similar reference numerals.

With reference to FIG. 17, the connection assembly 326 includes a bracket 338 similar to the bracket 138 but instead of fine adjustment surfaces 60 at the first and second bent ends 146, 150 includes two flat ends 342 that each have a slot 346. The slots 346 include a channel 350 that extends into an opening 354. The openings 354 are generally rectangular and include four sides that are orthogonal to adjacent sides. The connection assembly 326 further includes a fine adjustment bracket 358 (i.e., a centering nut) positioned in the openings 354 of each of the slots 346 and conical nuts 230. The fine adjustment bracket 358 is generally rectangular and includes an opening 360 positioned between two fine adjustment surfaces 366.

With reference to FIG. 18, during assembly, the flat ends 342 of the bracket 338 are aligned with the open ends of the first and second beams 18. The beams 18 are slid toward each other over the flat ends 342 of the bracket 338 to position the fasteners 90 in the slots 346. Simultaneously, an alignment tab 259 on the first end 70 of one beam 18 and an alignment tab 259 on the second end 74 of the other beam 18 are mated. The openings 98 allow access to the cavity 78 of the beams 18 and the fasteners 90 opposite the openings 98. The fine adjustment brackets 358 are then inserted into the cavity 78 and positioned in the openings 354 of the slots 346 with the fasteners 90 extending through the openings 360 of the fine adjustment brackets 358. The conical nuts 230 are then inserted into the cavity 78 through the opening 98 of the beam 18 and positioned on the fastener 90 with the fastener 90 extending though the opening 236. The conical nuts 230 are then tightened by clockwise rotation about axes 362 defined by the fasteners 90, as indicated by arrows 382. As the conical nuts 230 are tightened, the fine adjustment surfaces 246 on the conical nuts 230 contact one of the fine adjustment surfaces 366 of the fine adjustment brackets 358 to generate a clamping force.

The clamping force is collinear with the axes 362 of the fastener 90 and perpendicular to the beam axis 28. The clamping force draws the conical portions 242 of the conical nuts 230 against the fine adjustment surfaces 366 of the fine adjustment brackets 358. More specifically, the fine adjustment surface 246 of the conical nuts 230 and the fine adjustment surface 366 of the fine adjustment bracket 358 slide against each other under the influence of the clamping force. Because the fine adjustment surfaces 246, 366 are at a non-zero fine adjustment angle with respect to the beam axis 28, the clamping force is divided into a component that is perpendicular to the beam axis 28 (i.e., parallel to the fastener axes 362) and a component that is parallel to the beam axis 28 (i.e., perpendicular to the fastener axes 362). The component of force that is parallel to the beam axis 28 draws the first beam 18 toward the second beam 18 (i.e., causes the beams 18 to slide over the bracket 338 towards each other) for a snug fit. Thus, the first beam 18 is secured flush to the second beam 18. Finally, fasteners 268 are secured to the apertures 270 in the beam 18 and apertures 386 (FIG. 17) in the bracket 338. The fasteners 268 prevent the beams 18 from moving in a direction parallel to the fastener axis 262 relative to the bracket 338. The number (eight in the illustrated embodiment—four for each beam 18) and spacing of the fasteners 268 also ensure a planar clamping action between the top of each beam 18 and the top of the bracket 338. The top of the bracket 338 is therefore a datum or reference surface against which the top walls of the beams 18 are clamped. Because the fasteners 268 are arranged in a non-linear pattern (e.g., at least three non-linear points to define a plane), they clamp the top of the beam 18 flush against the top of the bracket 338. The top of each beam 18 is not permitted to tip up or down with respect to the top of the bracket 338 and is held flat in the same plane as the top of the other beam 18. As such, the top surfaces of the beams 18 are flush with one another at the joint.

Figure 20:
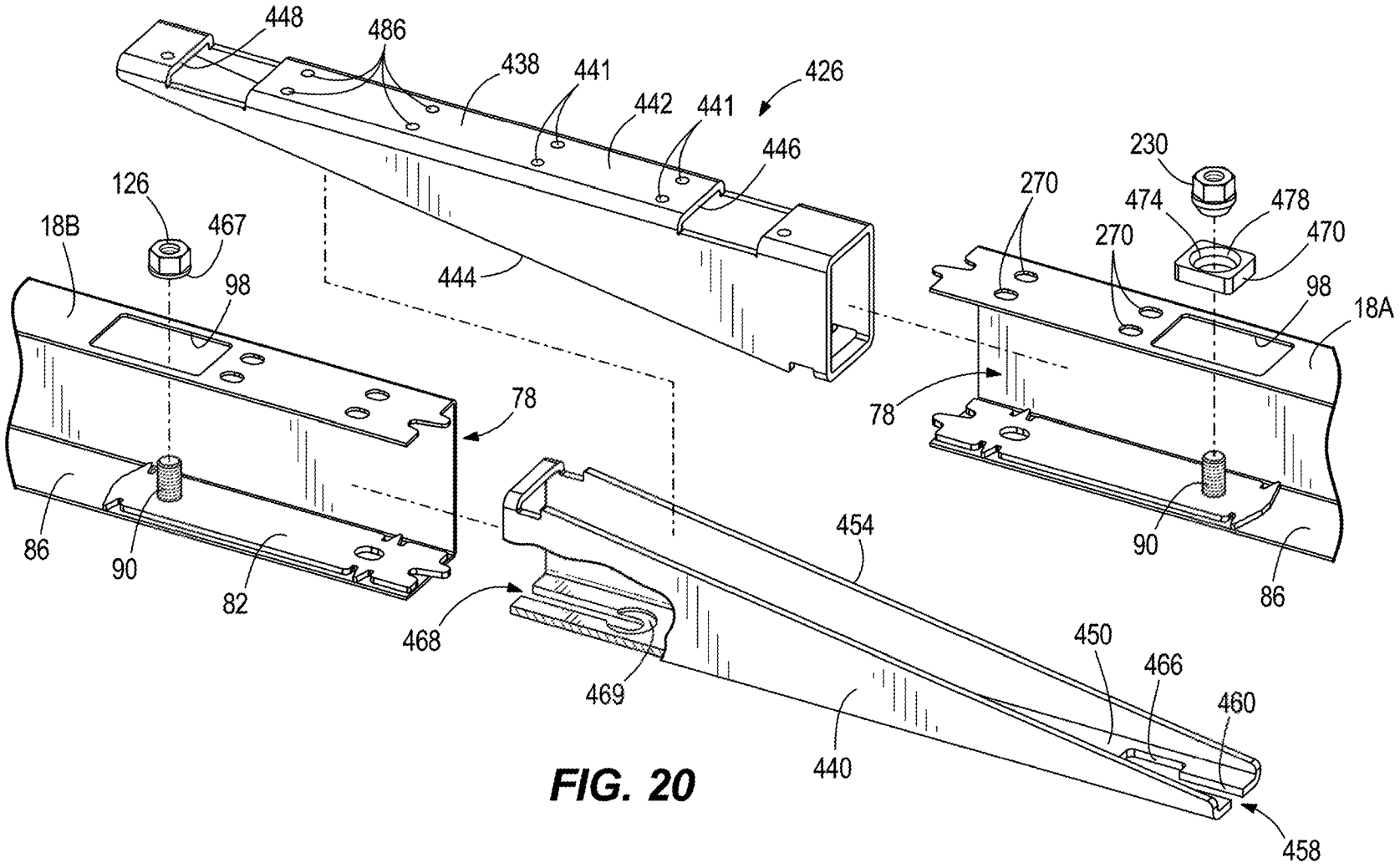
FIG. 20 is an exploded view of a beam and beam connection according to another embodiment of the invention.
Figure 21:
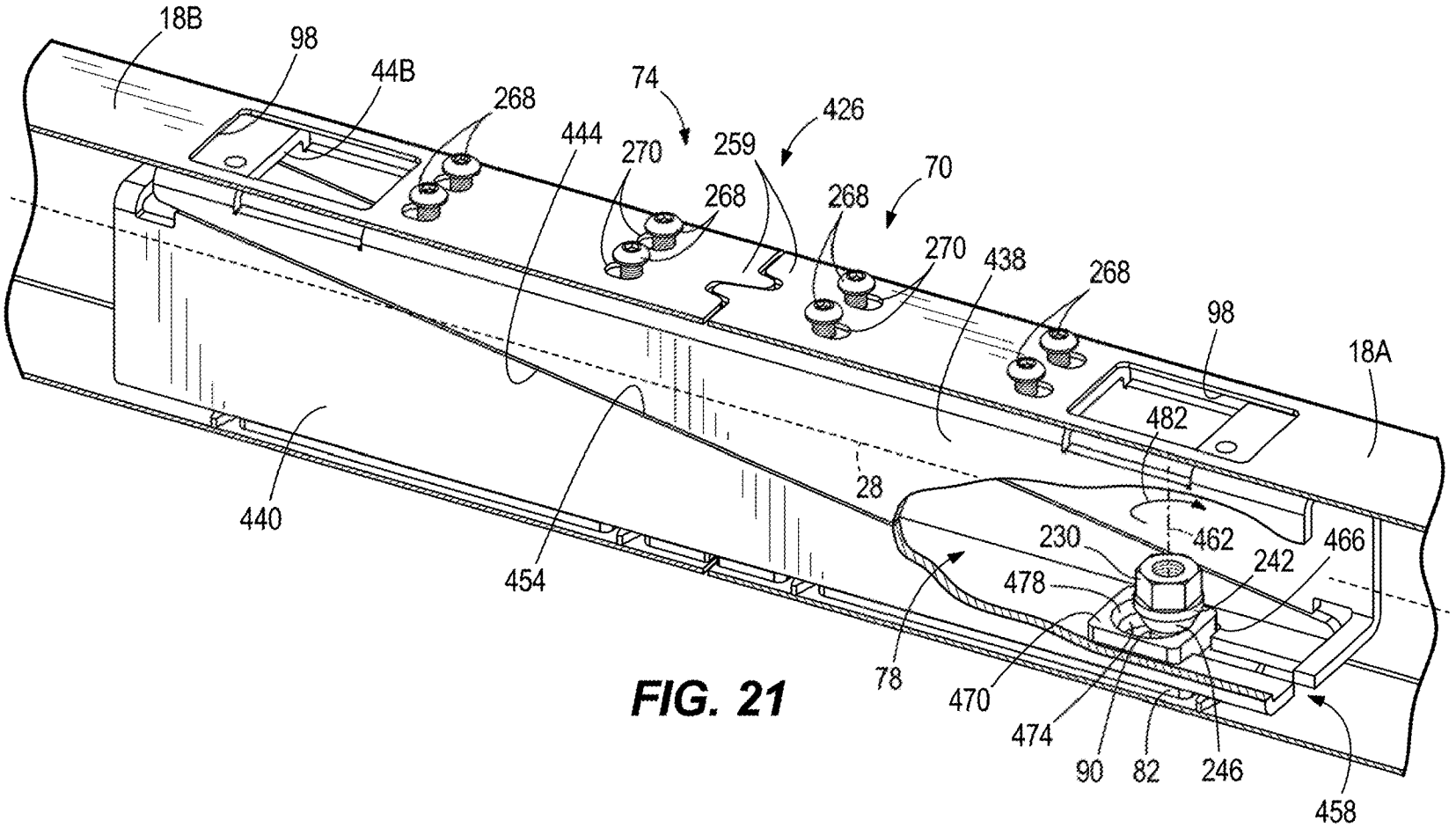
FIG. 21 is a perspective view of a partial cross-section of the beam and beam connection of FIG. 20.
Figure 22:
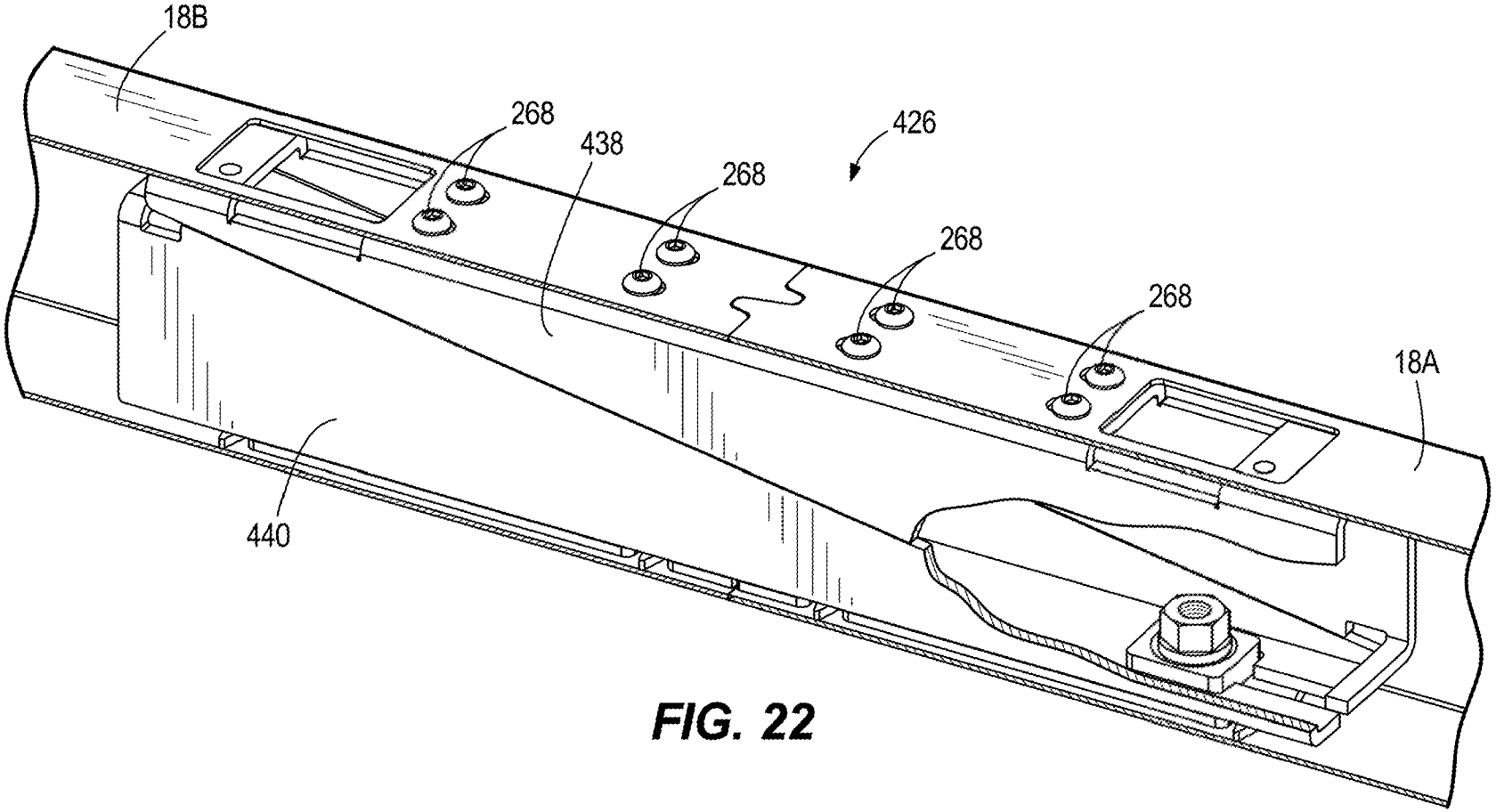
FIG. 22 is a perspective view of a partial cross-section of the beam to beam connection of FIG. 20 assembled.

FIGS. 20-22 illustrate a connection assembly 426 for coupling a beam 18 to a beam 18 in parallel, end-to-end (i.e., with the beam axes 28 of the two beams 18 collinear). In other embodiments, the connection assembly 426 may couple a post 14 to a beam 18. The connection assembly 426 is similar to the connection assembly 26 with similar features being represented by similar reference numerals.

With reference to FIG. 20, the connection assembly 426 includes a first bracket 438 on a first beam 18A and a second bracket 440 on a second beam 18B. Fasteners 268 (FIG. 21) extend through a first plurality of apertures 441 on the first bracket 438 and the apertures 270 on the first beam 18A to secure the first bracket 438 to the first beam 18A. When secured to the first beam 18A, the first bracket 438 partially extends out of the cavity 78. The first bracket 438 includes a top surface 442 and an inclined surface 444 extending from the top surface 442 to make the first bracket 438 generally triangular-shaped. The first bracket 438 also includes a first opening 446 in the top surface 442 that is positioned within the cavity 78 of the first beam 18A and aligned with the opening 98 of the first beam 18A. A second opening 448 on the top surface 442 is similar to the first opening 446 but is positioned out of the cavity 78. When assembled, the second opening 446 is aligned with the opening 98 on the second beam 18B. The second bracket 440 includes a bottom surface 450 and an inclined surface 454 extending from the bottom surface 450 to make the second bracket 440 generally triangular-shaped. When assembling the connection assembly 426, the inclined surface 444 of the first bracket 438 and the inclined surface 454 of the second bracket 440 help axially align the first and second beams 18A, 18B. The second bracket 440 also includes a first slot 458 with a channel 460 and an opening 466. The opening 466 is generally rectangular with adjacent sides being orthogonal to each other. The second bracket 440 is secured to the bottom surface 86 of the second beam 18B using the fastener 90 on the support 82 and a nut (e.g., nut 126, conical nut 230, etc.). The second bracket 440 further includes a second slot 468 on the bottom surface 450 of the second. The second slot 468 ends in a circular recess 469 that a bottom surface 467 of the nut 126 is positioned and secured to clamp the second bracket 440 to the second beam 18B.

The connection assembly 426 further includes a fine adjustment bracket 470 (i.e., a centering nut) positioned in the opening 466 of the first slot 458 and a conical nut 230. The fine adjustment bracket 470 is generally rectangular and includes a circular opening 474 in the center. One side of the fine adjustment bracket 470 includes a beveled edge around the opening 466 that defines a fine adjustment surface 478.

With reference to FIG. 21, during assembly, the inclined surfaces 444, 454 of the first and second beams 18A, 18B are axially aligned with each other. The first and second beams 18A, 18B are slid toward each other to position the second opening 448 of the first bracket 438 under the opening 98 of the second beam 18B. The inclined surfaces 444, 454 are in continuous contact with each other as the first and second beams 18A, 18B are slid towards each other to prevent relative movement of the beams 18A, 18B in directions perpendicular (e.g., up and down) and parallel to the beam axes 28. Meanwhile, as the first and second beams 18A, 18B are slid towards each other, the fastener 90 on the support 82 of the first beam 18A registers with the first slot 458 and into the opening 466 while an alignment tab 259 on the first end 70 of the first beam 18A and an alignment tab 259 on the second end 74 of the second beam 18B are mated. The fine adjustment bracket 470 is then inserted into the cavity 78 of the first beam 18 through the opening 98 of the first beam 18 and positioned in the opening 466 of the first slot 458 with the fastener 90 extending through the opening 474 of the fine adjustment bracket 470. The conical nut 230 is then inserted into the cavity 78 through the opening 98 of the beam 18 and positioned on the fastener 90 with the fastener 90 extending though the opening 474 of the adjustment bracket 470. The conical nut 230 is then tightened by clockwise rotation about an axis 462 defined by the fastener 90, as indicated by arrow 482. As the conical nut 230 is tightened, the fine adjustment surface 246 on the conical nut 230 contacts the fine adjustment surface 478 of the fine adjustment bracket 470 to generate a clamping force. Simultaneously, the inclined surface 444 of the first bracket 438 engages the inclined surface 454 of the second bracket 440.

The clamping force is collinear with the axis 462 of the fastener 90 and perpendicular to the beam axis 28. The clamping force draws the conical portion 242 of the conical nut 230 against the fine adjustment surface 478 of the fine adjustment bracket 470. More specifically, the fine adjustment surface 246 of the conical nut 230 and the fine adjustment surface 478 of the fine adjustment bracket 470 slide against each other under the influence of the clamping force. Likewise, the inclined surfaces 444, 454 slide against each other under the influence of the clamping force. Because the fine adjustment surfaces 246, 478 are at a non-zero fine adjustment angle with respect to the beam axis 28, the clamping force is divided into a component that is perpendicular to the beam axis 28 (i.e., parallel to the fastener axis 462) and a component that is parallel to the beam axis 28 (i.e., perpendicular to the fastener axis 462). The component of force that is parallel to the beam axis 28 draws the first beam 18A toward the second beam 18B (i.e., causes the inclined surfaces 444, 454 to slide over each other) for a snug fit. Thus, the first beam 18A is secured flush to the second beam 18B. Finally, additional fasteners 268 are secured to the apertures 270 in the second beam 18B and a second plurality of apertures 486 (FIG. 20) on the top surface 442 of the first bracket 438. The fasteners 268 prevent the beams 18A, 18B from moving in a direction parallel to the fastener axis 462 relative to each other. The fasteners 268 also clamp the top walls of the beams 18A, 18B to the top of the first bracket 438 in a planar clamping manner as described above with respect to FIGS. 18 and 19. As such, the top surfaces of the beams 18A, 18B are flush with each other.

A connection assembly 26, 226, 326, 426 that uses fine adjustment surfaces 60, 120, 366, 478 to draw two structures together in the final tightening step of assembly results in a tight, strong joint for the architectural structure 10. When the joints between beams 18 and posts 14 of an architectural structure 10 are tight, the effects of vibrational and impact loads on the architectural structure 10 are minimized. Tight joints between the beams 18 and posts 14 also assist in the assembly of an architectural structure 10. Sloppy or loose joints between the beams 18 and posts 14 can make it difficult to align structures that are being added to the architectural structure 10 later in the assembly process. Tight joints eliminate this error and facilitate quick and easy assembly of an architectural structure 10.

The connection assembly 26, 226, 326, 426 for securing a first structure to a second structure generally includes a first fine adjustment surface 60, 246, a second fine adjustment surface 120, 258, 366, 478, and a clamping mechanism (e.g., a fastener 90 and a nut 126, 230). In some embodiments, the first fine adjustment surface 60 is on a first bracket and the second fine adjustment surface 120 is on a second bracket. The fine adjustment surfaces 60, 120, 246, 258 are inclined and rest upon one another. As the clamping mechanism is tightened in a clamping direction, it applies a clamping force to the first and second fine adjustment surfaces 60, 120, 246, 258, 366, 478. The clamping force causes the first fine adjustment surface 60, 246 to slide along the second fine adjustment surface 120, 258, 366, 478 at a non-zero angle with respect to the clamping direction. The non-zero angle of the fine adjustment surfaces 60, 120, 246, 258, 366, 478 with respect to the clamping direction gives rise to components of force parallel to and perpendicular to the clamping direction. The perpendicular component of force draws first and second structures toward each other until the joint between the first and second structures is tight. In other embodiments, the first fine adjustment surface 60, 246, the second fine adjustment surface 120 258, 366, 478 and the fastener 90 can be provided in other ways. In further embodiments, a fine adjustment surface may be provided on the clamping mechanism so as to create the clamping force and cause the fine adjustment surfaces to draw the first and second structures towards each other.

Various features and advantages of the invention are set forth in the following claims.

What is claimed is:

1. A connection for a subarchitectural workspace comprising:

a first structure with a first end and a second end opposite the first end, the first structure defining an axis extending centrally between the first and second ends;

a second structure with a first end and a second end opposite the first end;

a bracket with a fine adjustment surface supported by either the first or second structure, the fine adjustment surface being at a non-zero fine adjustment angle with respect to the axis; and a clamping mechanism that applies a clamping force to the fine adjustment surface to pull the first and second structures together in a direction parallel to the axis.

2. The connection of claim 1, wherein the bracket is a first bracket and the connection further includes a second bracket, and wherein the fine adjustment surface is a first fine adjustment surface and the second bracket includes a second fine adjustment surface that engages the first fine adjustment surface.

3. The connection of claim 2, wherein the first bracket includes a slot and the second bracket includes an aperture.

4. The connection of claim 3, wherein the clamping mechanism includes a fastener positioned within the slot of the first bracket and the aperture of the second bracket and a nut threaded onto the fastener.

5. The connection of claim 1, wherein the fine adjustment surface is a first fine adjustment surface and the clamping mechanism includes a second fine adjustment surface that engages the first fine adjustment surface.

6. The connection of claim 5, wherein the clamping mechanism is a conical nut.

7. The connection of claim 6, wherein the clamping mechanism further includes a centering nut.

8. The connection of claim 1, wherein the first structure is a vertical member and the second structure is a horizontal member.

9. The connection of claim 1, wherein the first structure is a first horizontal member and the second structure is a second horizontal member.

10. A connection for a subarchitectural workspace comprising:

a first structure with a first end and a second end opposite the first end, the first structure defining an axis extending centrally between the first and second ends;

a second structure with a first end and a second end opposite the first end;

a bracket supported by either the first or second structure, the bracket including a first fine adjustment surface; and a clamping mechanism including a second fine adjustment surface, the second fine adjustment surface being at a non-zero fine adjustment angle with respect to the axis, the second fine adjustment surface applies a clamping force to the first fine adjustment surface to pull the first and second structures together in a direction parallel to the axis.

11. The connection of claim 10, wherein the bracket is a first bracket and the connection assembly further includes a second bracket that includes the second fine adjustment surface.

12. The connection of claim 11, wherein the clamping mechanism includes a fastener and a nut threaded onto the fastener.

13. The connection of claim 11, wherein the first bracket includes at least one slot adjacent the first fine adjustment surface and the second bracket includes at least one aperture.

14. The connection of claim 13, wherein the clamping mechanism includes a fastener positioned within the slot of the first bracket and the aperture of the second bracket and a nut threaded onto the fastener.

15. The connection of claim 11, wherein the second bracket is a fine adjustment bracket.

16. The connection of claim 10, wherein the clamping mechanism is a conical nut.

17. The connection of claim 10, wherein the first structure is a vertical member and the second structure is a horizontal member.

18. The connection of claim 10, wherein the first structure is a first horizontal member and the second structure is a second horizontal member.

19. A connection assembly for coupling a first structure to a second structure comprising:

a threaded stud supported by either the first or second structure, the threaded stud defining a fastener axis;

a first bracket supported by either the first or second structure, the first bracket including a first fine adjustment surface; and a threaded nut with a second fine adjustment surface, the threaded nut coupled to the threaded stud in a direction parallel to the fastener axis so that the second fine adjustment surface engages the first fine adjustment surface and applies a clamping force to the first and second fine adjustment surface to urge the first and second structures together in a direction perpendicular to the fastener axis.

* * * * *